US010532241B2

(12) United States Patent
Boatner et al.

(10) Patent No.: US 10,532,241 B2
(45) Date of Patent: Jan. 14, 2020

(54) KETTLE BELL AND METHODS OF USE THEREOF

(71) Applicants: Brian Boatner, Pontotoc, MS (US); Blake T. Hudson, Smyrna, GA (US); Hamilton G. Moore, Irondale, AL (US)

(72) Inventors: Brian Boatner, Pontotoc, MS (US); Blake T. Hudson, Smyrna, GA (US); Hamilton G. Moore, Irondale, AL (US)

( * ) Notice: Subject to any disclaimer, the term of this patent is extended or adjusted under 35 U.S.C. 154(b) by 30 days.

(21) Appl. No.: 15/813,346

(22) Filed: Nov. 15, 2017

(65) Prior Publication Data

US 2018/0133539 A1 May 17, 2018

Related U.S. Application Data

(60) Provisional application No. 62/422,105, filed on Nov. 15, 2016.

(51) Int. Cl.

| | |
|---|---|
| ***A63B 21/072*** | (2006.01) |
| ***A63B 21/00*** | (2006.01) |
| ***A63B 21/06*** | (2006.01) |

(52) U.S. Cl.

CPC ..... *A63B 21/0722* (2015.10); *A63B 21/072* (2013.01); *A63B 21/0724* (2013.01); *A63B 21/0726* (2013.01); *A63B 21/4035* (2015.10); *A63B 21/0603* (2013.01)

(58) Field of Classification Search

CPC ..... A63B 21/02; A63B 21/07; A63B 23/12; A63B 21/40; A63B 21/06

See application file for complete search history.

(56) References Cited

U.S. PATENT DOCUMENTS

| | | | | | |
|---|---|---|---|---|---|
| 1,316,683 | A * | 9/1919 | Calvert | A63B 21/072 | 473/125 |
| 1,917,566 | A * | 7/1933 | Wood | A63B 21/075 | 482/108 |
| 2,676,802 | A * | 4/1954 | O'Brien | A63B 21/0724 | 482/106 |
| 3,336,029 | A * | 8/1967 | London | A63B 69/00 | 463/47.2 |
| 3,756,597 | A * | 9/1973 | Monti | A63B 21/0004 | 482/106 |
| 4,029,312 | A * | 6/1977 | Wright | A63B 21/0602 | 482/106 |
| 4,103,887 | A * | 8/1978 | Shoofler | A63B 21/0602 | 222/528 |
| 4,369,968 | A * | 1/1983 | Price | A63B 21/0601 | 482/106 |

(Continued)

FOREIGN PATENT DOCUMENTS

| | | |
|---|---|---|
| GB | 2516269 | 1/2015 |
| WO | 2013181757 | 12/2013 |

*Primary Examiner* — Garrett K Atkinson
(74) *Attorney, Agent, or Firm* — Gardner Groff & Greenwald, PC

(57) ABSTRACT

A kettle bell including a weighted mass and a handle or grasping ring extending from an upper portion of the mass, and at least one opening or receiver formed through at least a portion of the mass and/or handle. In example embodiments, the at least one opening or receiver is provided for accommodating interengagement with the end male receivers of a barbell or other exercise device.

20 Claims, 7 Drawing Sheets

(56) References Cited

U.S. PATENT DOCUMENTS 4,618,142 A * 10/1986 Joseph, Jr. ..... A63B 5/20 482/106
4,634,121 A * 1/1987 Sasaki ..... A63B 15/00 473/457
4,695,051 A * 9/1987 Jenison ..... A63B 21/0602 482/108
4,709,922 A * 12/1987 Slade, Jr. ..... A63B 21/0783 482/104
4,756,526 A * 7/1988 Broussard ..... A63B 21/0724 482/108
4,978,122 A 12/1990 Dibowski
4,998,721 A * 3/1991 Anders ..... A63B 21/0783 482/4
4,998,723 A * 3/1991 Santoro ..... A63B 21/078 482/104
5,029,849 A * 7/1991 Nurkowski ..... A63B 21/072 482/106
5,102,124 A * 4/1992 Diodati ..... A63B 21/0605 482/106
5,242,348 A 9/1993 Bates
5,310,394 A * 5/1994 Kallios ..... A63B 21/00181 482/104
5,344,375 A * 9/1994 Cooper ..... A63B 21/0728 482/106
D356,351 S * 3/1995 Watts ..... D21/691
5,531,657 A * 7/1996 Macedo ..... A63B 21/0084 482/106
5,692,996 A 12/1997 Widerman
5,823,921 A * 10/1998 Dawson ..... A63B 21/00181 482/104
5,842,957 A * 12/1998 Wheeler ..... A63B 21/0602 482/111
5,871,423 A * 2/1999 Pruchnik ..... A63B 21/22 482/1
5,891,004 A * 4/1999 Berry ..... A63B 21/04 482/106
5,989,164 A * 11/1999 Kullman ..... A63B 21/0783 482/104
6,099,441 A * 8/2000 Bonnet ..... A63B 21/072 482/106
6,190,292 B1 * 2/2001 Panes ..... A63B 21/06 482/109
6,261,211 B1 * 7/2001 Suarez ..... A63B 21/0603 482/107
6,293,892 B1 * 9/2001 Slawinski ..... A63B 21/00181 482/104
6,379,287 B1 * 4/2002 Slawinski ..... A63B 21/00181 482/104
6,648,804 B2 * 11/2003 Chen ..... A63B 21/0004 482/125
6,746,380 B2 6/2004 Lien et al.
6,893,381 B2 * 5/2005 Slawinski ..... A63B 21/078 482/104
6,926,649 B2 * 8/2005 Slawinski ..... A63B 21/00181 482/104
7,052,445 B2 * 5/2006 Ekhaus ..... A63B 21/0601 482/108
7,198,591 B2 4/2007 Lien
7,201,711 B2 * 4/2007 Towley, III ..... A63B 21/0605 482/106
7,563,208 B1 * 7/2009 Chen ..... A63B 21/0728 482/108
7,753,827 B1 * 7/2010 Emick ..... A63B 21/00181 482/44
7,883,452 B1 * 2/2011 Chen ..... A63B 21/072 482/108
D635,206 S 3/2011 Henniger
D636,038 S 4/2011 Henniger
D636,039 S 4/2011 Henniger
D636,040 S 4/2011 Henniger
7,942,792 B1 5/2011 Wyman et al.
8,267,841 B1 * 9/2012 Allison ..... A63B 21/06 482/106
D676,091 S 2/2013 Henniger
8,444,537 B1 * 5/2013 Santoro ..... A63B 21/078 482/104
8,454,483 B1 * 6/2013 Bradley ..... A63B 21/072 482/44
8,568,280 B2 10/2013 Mendoza
8,585,563 B2 * 11/2013 Wilson ..... A63B 21/0004 482/106
D708,682 S * 7/2014 Jones ..... D21/680
8,784,281 B2 * 7/2014 Johnson, III ..... A63B 21/0783 482/104
8,882,642 B2 11/2014 Chavez et al.
8,911,334 B1 12/2014 Cotter et al.
8,944,971 B2 2/2015 Shorter
8,979,719 B2 * 3/2015 Januszek ..... A63B 21/072 482/106
D726,264 S * 4/2015 Agate ..... D21/682
9,095,742 B2 8/2015 Henniger et al.
9,126,079 B2 * 9/2015 Jordan ..... A63B 21/072
9,149,680 B2 * 10/2015 Thompson ..... A63B 21/0726
9,216,315 B1 12/2015 Chang et al.
D748,212 S * 1/2016 Gangemi ..... D21/681
9,364,703 B1 * 6/2016 Kuka ..... A63B 21/0726
9,364,704 B1 6/2016 Kuka
9,409,220 B2 8/2016 Henniger et al.
9,504,866 B2 11/2016 Peralo
9,504,867 B2 11/2016 Hall
9,616,269 B1 * 4/2017 Burosh ..... A63B 21/072
9,616,270 B2 * 4/2017 Towley ..... A63B 21/075
9,694,230 B2 * 7/2017 Cooper ..... A63B 21/0603
9,694,236 B2 * 7/2017 Rost ..... A63B 23/0355
9,731,159 B2 * 8/2017 Reynolds ..... A63B 21/0722
9,770,619 B1 * 9/2017 Bullock ..... A63B 21/0603
9,884,239 B2 * 2/2018 Kay ..... A63B 21/153
D812,699 S * 3/2018 Thell ..... D21/680
10,086,225 B2 * 10/2018 Sheppard ..... A63B 21/0722
10,213,638 B2 * 2/2019 Black ..... A63B 21/0724
2001/0001094 A1 * 5/2001 Panes ..... A63B 21/06 482/93
2002/0198081 A1 * 12/2002 Chen ..... A63B 21/0004 482/23
2004/0077466 A1 4/2004 Wallace et al.
2006/0003874 A1 1/2006 Hamilton
2006/0035767 A1 * 2/2006 Ekhaus ..... A63B 21/0601 482/108
2007/0179030 A1 * 8/2007 Slawinski ..... A63B 21/00181 482/98
2007/0287609 A1 * 12/2007 McBride ..... A63B 21/065 482/105
2011/0263393 A1 10/2011 Ross et al.
2012/0046148 A1 2/2012 Aguila
2012/0053024 A1 3/2012 Mendoza
2012/0157270 A1 6/2012 Johnson
2012/0172182 A1 7/2012 Leier et al.
2012/0184418 A1 * 7/2012 Wilson ..... A63B 21/00043 482/112
2012/0244999 A1 * 9/2012 Tauriainen ..... A63B 21/078 482/104
2012/0309595 A1 12/2012 Dike
2013/0065738 A1 3/2013 Henniger et al.
2013/0190143 A1 * 7/2013 Greenhill ..... A63B 21/0058 482/104
2013/0245611 A1 9/2013 Bonnet et al.
2013/0267390 A1 10/2013 Warren
2014/0018214 A1 * 1/2014 Jordan ..... A63B 21/072 482/107
2014/0024507 A1 * 1/2014 Hagos ..... A63B 21/0726 482/108
2014/0057767 A1 2/2014 Henniger et al.
2014/0073493 A1 * 3/2014 Parish ..... A63B 21/0724 482/104
2014/0080680 A1 3/2014 Henniger et al.
2014/0119811 A1 5/2014 Henniger et al.
2014/0141944 A1 * 5/2014 Johnson ..... A63B 21/075 482/93
2014/0336021 A1 11/2014 Jones

(56) References Cited

U.S. PATENT DOCUMENTS

| | | | | |
|---|---|---|---|---|
| 2014/0336022 | A1 | 11/2014 | Jones | |
| 2014/0342885 | A1 | 11/2014 | Jones | |
| 2015/0011370 | A1 | 1/2015 | Henniger | |
| 2015/0133271 | A1 | 5/2015 | Jones | |
| 2015/0190672 | A1* | 7/2015 | Rost | A63B 23/0355 482/93 |
| 2015/0196119 | A1 | 7/2015 | Henniger | |
| 2015/0343257 | A1* | 12/2015 | Cooper | A63B 21/0603 482/93 |
| 2015/0367168 | A1 | 12/2015 | Henniger | |
| 2016/0030797 | A1* | 2/2016 | Erickson | A63B 21/068 482/132 |
| 2016/0045780 | A1 | 2/2016 | Henniger | |
| 2016/0263461 | A1* | 9/2016 | Kay | A63B 21/0783 |
| 2017/0021223 | A1* | 1/2017 | Ramsey | A63B 21/0724 |
| 2017/0266478 | A1* | 9/2017 | Black | A63B 21/0724 |
| 2017/0319895 | A1* | 11/2017 | Davis | A63B 21/072 |
| 2018/0001132 | A1* | 1/2018 | Brown, Jr. | A63B 21/027 |
| 2018/0140890 | A1* | 5/2018 | Sheppard | A63B 21/0722 |

* cited by examiner

KETTLE BELL AND METHODS OF USE THEREOF

CROSS-REFERENCE TO RELATED APPLICATION

This application claims the benefit of U.S. Provisional Patent Application Ser. No. 62/422,105, filed Nov. 15, 2016, the entirety of which is hereby incorporated herein by reference.

TECHNICAL FIELD

The present invention relates generally to the field of exercise equipment, and more particularly to exercise weights or weighted objects such as a kettle bell.

BACKGROUND OF THE INVENTION

Kettle bells are commonly used for lifting in various exercises, for example, wherein the user generally grasps the kettle bell with one or more hands, and generally lifts the kettle bell in some fashion. One drawback to kettle bells is that they are generally only capable of being grasped, for example, wherein a handle generally extends from a portion of the kettle bell that is sized and shaped for being grasped by one or more hands of a user. Continuous improvements to kettle bells are sought. It is to the provision of an improved kettle bell and methods of use thereof meeting these and other needs that the present invention is primarily directed.

SUMMARY OF THE INVENTION

In example embodiments, the present invention provides a kettle bell and methods of using the kettle bell. According to one example embodiment, the invention includes a kettle bell comprising a weighted base portion, a grasping handle extending from the base portion for receiving one or more hands of the user or lifter, and a conduit or opening extending through the base portion. In example embodiments, the opening of the base portion is generally cylindrical in shape, and is generally sized for receiving an end collar member of a barbell. Optionally, the opening generally extends entirely through at least a portion of the weighted member, and is shaped as desired (e.g., hexagonal, polygonal, triangular, oval, etc.).

In one aspect, the present invention relates to a kettle bell including a generally spherical shaped weighted mass, a generally flat bottom for resting atop a support surface, a handle extending from an upper portion of the mass to form a loop-like grasping ring, and an opening extending entirely through a generally central area of the mass. In example embodiments, the opening is provided for accommodating interengagement with the end male receivers of a barbell In another aspect, the invention relates to a method of using a kettle bell for exercising. The method includes providing a kettle bell, the kettle bell having a weighted mass, a handle extending from an upper portion of the mass to form a grasping ring, and at least one receiver opening; grasping the grasping ring of the kettle bell with one or more hands of a user; performing one or more exercises; providing a barbell comprising male collar end receivers; removably attaching a kettle bell to each of the collar end receivers, wherein the collar end receivers are fitted through the at least one receiver opening of each kettle bell; and performing one or more exercises by grasping and lifting the barbell.

In example embodiments, the at least one receiver opening is at least partially formed in the weighted mass. In example embodiments, wherein the at least one receiver opening is at least partially formed in the handle. In example embodiments, wherein the weighted mass includes a generally flat bottom for resting atop a support surface. In example embodiments, wherein at least the spherical shaped weighted mass includes iron. In example embodiments, wherein the kettle bell includes a total weight of between 5-115 pounds. In example embodiments, wherein the kettle bell further includes a clasp or fastener for securing the kettle bell to the collar end of the barbell.

In another aspect, the invention relates to a multi-use exercise device including a weighted mass and a grasping ring extending from the base and including a grasping portion and extension portions extending from the grasping portion. The extension portions each including a collar member having an opening extending therethrough, the opening of each collar member configured for receiving a collar end of a barbell such that the weighted mass is removably mountable to the collar end of the barbell.

In example embodiments, the weighted mass includes a pair of receivers and the extension portions of the grasping ring include extension ends for engagement with the receivers of the weighted mass. In example embodiments, at least the weighted mass includes iron. In example embodiments, the multi-use exercise device has a total weight of between 5-115 pounds. In example embodiments, the weighted mass includes a generally flat bottom for resting atop a support surface.

In yet another aspect, the invention relates to a kettle bell including a generally spherical shaped weighted mass, a handle extending from an upper portion of the mass to form a grasping ring, and at least one receiver opening configured for attachment of the kettle bell to a collar end of a barbell.

In example embodiments, the at least one receiver opening is at least partially formed in the generally spherical shaped weighted mass. In example embodiments, the at least one receiver opening is at least partially formed in the grasping ring. In example embodiments, the weighted mass includes a generally flat bottom for resting atop a support surface. In example embodiments, at least the spherical shaped weighted mass includes iron. In example embodiments, the kettle bell comprises a total weight of between 5-115 pounds.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In example embodiments, the present invention provides a kettle bell and methods of using the kettle bell. According to one example embodiment, the invention includes a kettle bell comprising a weighted base portion, a grasping handle extending from the base portion for receiving one or more hands of the user or lifter, and a conduit or opening extending through the base portion. In example embodiments, the opening of the base portion is generally cylindrical in shape, and is generally sized for receiving an end collar member of a barbell. Optionally, the opening generally extends entirely through at least a portion of the weighted member, and is shaped as desired (e.g., hexagonal, polygonal, triangular, oval, etc.).

Figure 2:
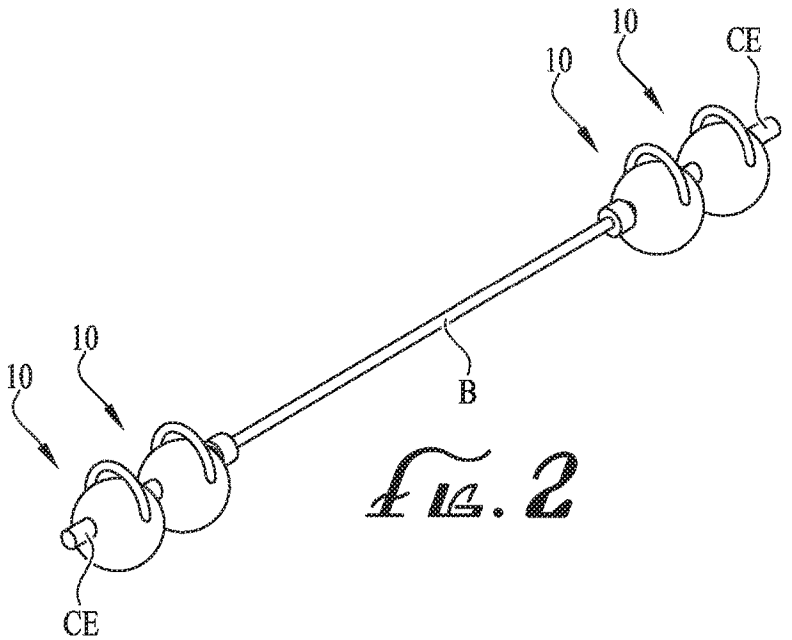
FIG. 2 is a perspective view of a weight assembly according to example embodiments of the present invention, showing a barbell having kettle bells removably attached to the ends thereof.
Figure 3:
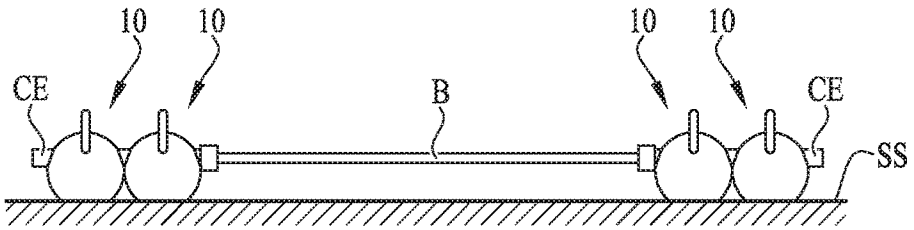
FIG. 3 is a front view of the weight assembly of FIG. 2.
Figure 1:
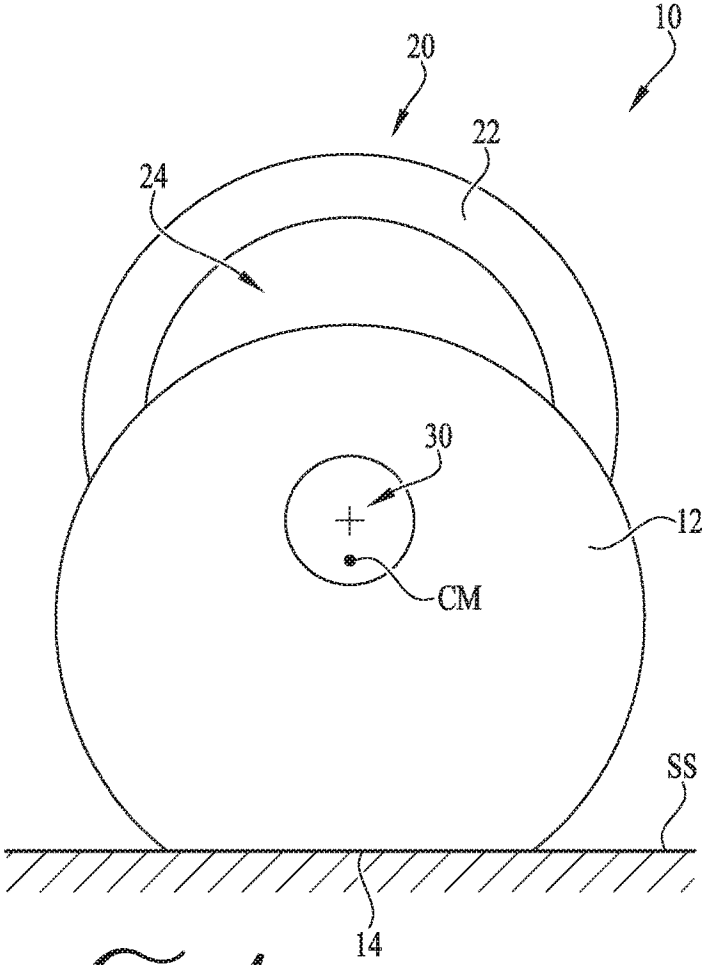
FIG. 1 is a front view of a kettle bell according to an example embodiment of the present invention.

With reference now to the drawing figures, wherein like reference numbers represent corresponding parts throughout the several views, FIG. 1 shows a kettle bell 10 according to an example embodiment of the present invention. As depicted, the kettle bell 10 comprises a generally spherical shaped weighted mass or object 12, with a generally flat bottom 14 for resting atop a support surface SS, and a handle 20 extending from an upper portion of the mass 12 to form a loop-like grasping ring 22. In alternate example embodiments, the weighted mass or object 12 can be shaped as desired. In example embodiments, an opening 24 is defined between the ring 22 and the upper portion of the mass 12. In preferred example embodiments, an opening 30 extends entirely through a generally central area of the mass 12, for example, to provide for accommodating interengagement with the end male receivers or collar ends CE of a barbell B. For example, as depicted in FIGS. 2-3, each of the collar ends CE of the barbell B are engaged with two kettle bells 10, for example, to provide an alternative option for adding additional weight to the collar ends CE of the barbell B, for example, rather than utilizing standard plate or disc-shaped weights. According to example embodiments, the barbell B with one or more of the kettle bells 10 removably engaged at each collar end CE can be used by the user, for example, to perform dead lift exercises, or for example, a bench-type chest exercise, a shoulder press exercise, or additional types of exercises as desired.

In example embodiments, the collar ends CE of the barbell comprise a diameter of about 50 millimeters or about 2 inches, and the opening 30 comprises a diameter that is at least partially larger than the collar end CE diameter such that the collar end CE can slidingly engage with the opening 30. In some example embodiments, the opening can be substantially larger than the diameter of the collar end CE, and one or more frictional pads or inserts can be provided for allowing a generally tight-fitting engagement. Optionally, a rubber sleeve can be provided on the collar ends CE, and the opening 30 is generally sized to fit over the rubber sleeve.

As depicted in FIG. 1, the opening 30 is generally formed through the entirety of at least a portion of the mass 12. In example embodiments, the opening 30 is generally positioned at least partially above the center of mass CM of the kettle bell 10. As such, when the kettle bell 10 is removably mounted to the collar end CE, the kettle bell 10 remains oriented upright (due to the center of mass CM being positioned below the center of the opening 30), for example, such that the bottom 14 remains generally parallel with the support surface SS.

Figure 4:
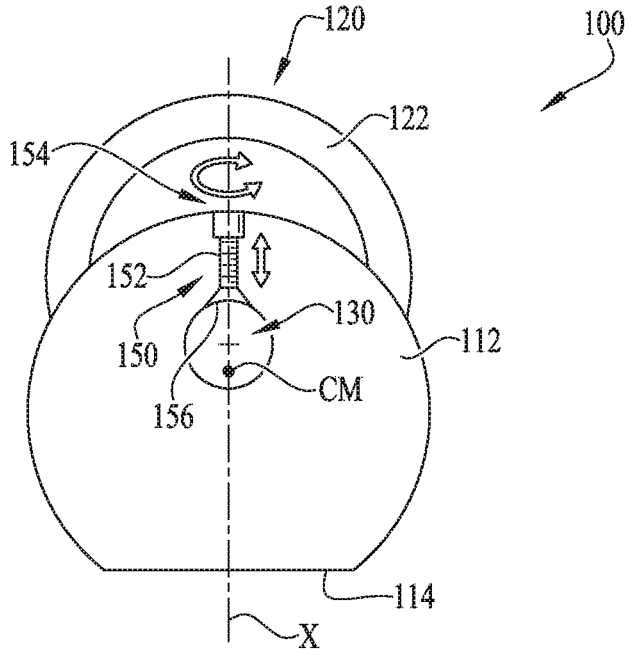
FIG. 4 is a front view of a kettle bell according to another example embodiment of the present invention.

FIG. 4 shows a kettle bell 100 according to another example embodiment of the present invention. As depicted, the kettle bell 100 is substantially similar to the kettle bell 10 as described above. For example, the kettle bell 100 generally comprises a generally spherical shaped weighted mass or object 112, with a generally flat bottom 114 for resting atop a support surface SS, and a handle 120 extending from an upper portion of the mass 112 to form a loop-like grasping ring 122. Similarly, an opening 130 extends entirely through the mass 112, for example, such that the center of the opening 130 is generally positioned at least partially above the center of mass CM of the mass 112. According to example embodiments, a retaining mechanism or stop member 150 is provided with the mass 112, which comprises a central shaft 152 extending between an adjustment portion 154 and an engagement portion 156. In example embodiments, the adjustment portion 154 can be rotated about axis X, which provides for translation (up and down) of the engagement portion 156 into and out of the opening 130. For example, after the collar end CE is fitted through the opening, the adjustment portion 154 can be rotated to cause frictional engagement of the engagement portion 156 with an outer periphery of the collar end CE. Thus, the retaining mechanism 150 preferably provides for securing the kettle bell 100 to the collar end CE, thereby preventing the kettle bell 100 from unintentional disengagement from the collar end CE during use. In some example forms, the engagement portion 156 is generally curved or radiused to follow the curvature of the opening 130, for example, such that in a fully retracted position, the collar end CE is slidably engageable with the opening. Further, when the engagement portion 156 is in an engaged position, the curved surface of the engagement portion 156 is generally substantially frictionally engaged with an outer periphery portion of the collar end CE. Optionally, the engagement portion 156 can be shaped as desired for providing engagement with the collar end CE. Optionally, other retaining mechanisms, fasteners, coupling members, etc. can be used as desired, for example, to provide for removably attaching the kettle bell 100 to the collar end CE. In example embodiments, the engagement portion can be formed from a rubber or high friction material, for example, for increasing the frictional engagement with the outer periphery of the collar end CE.

Figure 5:
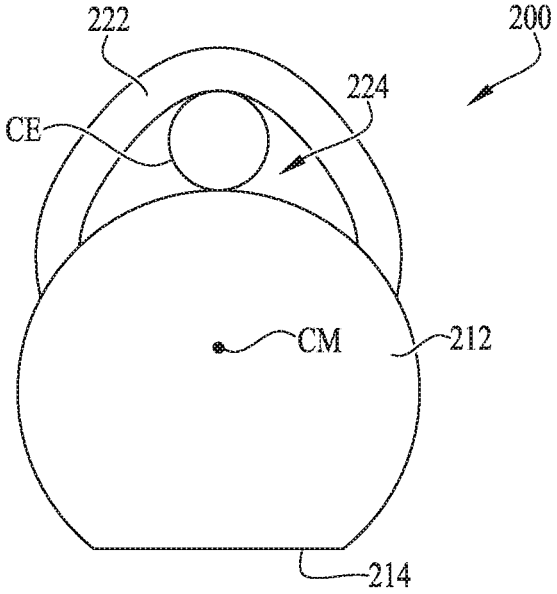
FIG. 5 is a front view of a kettle bell according to another example embodiment of the present invention.

FIG. 5 shows a kettle bell 200 according to another example embodiment of the present invention. As depicted, the kettle bell 200 is substantially similar to the kettle bell 10 as described above. According to one example form, the grasping handle or ring 222 is preferably sized and shaped such that the opening 224 that is defined between the ring 222 and the mass 212 can receive the collar end CE. Thus, rather than removable attachment of the kettle bell with the collar end CE by providing an opening within the mass, the opening 224 defined between the ring 222 and the mass 212 is sized and shaped to receive the collar end CE or to be grasped by one or more hands us a user. Preferably, one or more retaining members, fasteners, couplings, etc. can be provided for removably securing the kettle bell 200 to the collar end CE.

Figure 6:
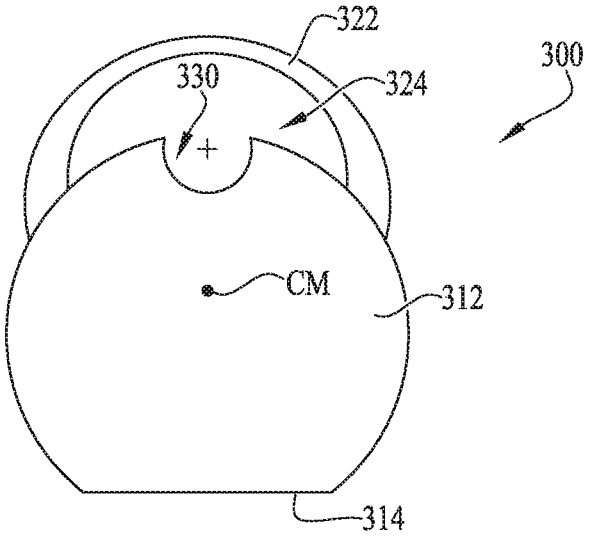
FIGS. 6-8 show a kettle bell according to another example embodiment of the present invention.
Figure 7:
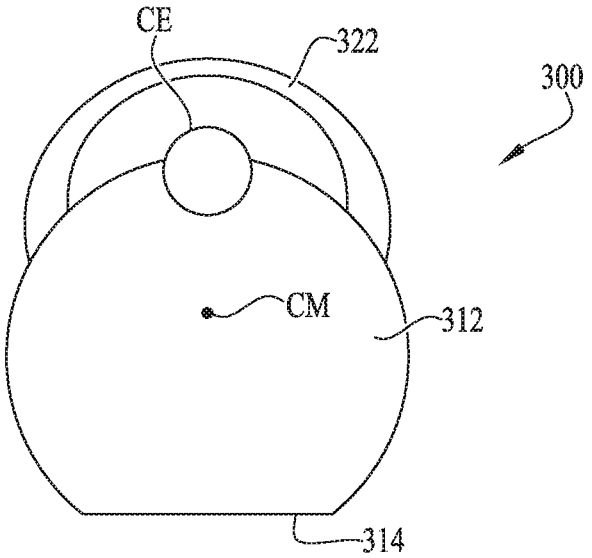
Figure 8:
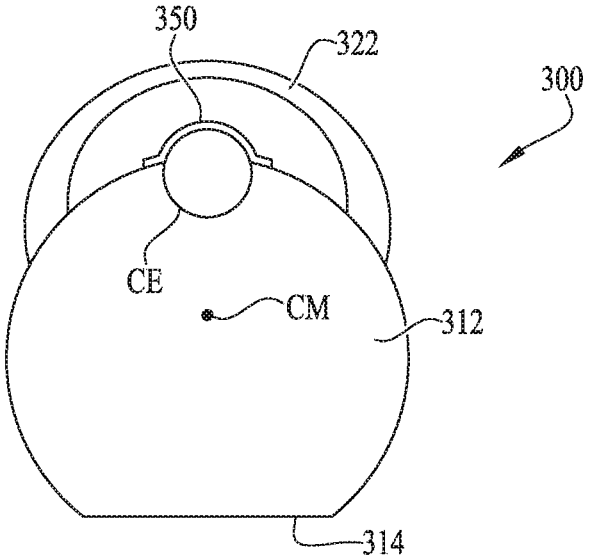

FIGS. 6-8 show a kettle bell according to another example embodiment of the present invention. As depicted, the kettle bell 300 is substantially similar to the kettle bell 10 as described above. In example embodiments, an opening 330 extends entirely through an upper portion of the mass 312, which provides for receiving the collar end CE of the barbell B. In example embodiments, the opening 330 is positioned substantially above the center of mass CM of the mass 312. In example embodiments, the center of the opening 330 is generally configured to be at least partially below the outer peripheral surface of the mass 312. Thus, the opening 330 defines a U-shaped channel, which is at least partially more than half of a circle (e.g., greater than 180 degrees) such that the collar end CE is prevented from disengaging the kettle bell 300 during use. Accordingly, the collar end CE is permitted to slidingly engage with the opening 330 of the kettle bell 300 during attachment or detachment thereof, however, as the opening 330 is generally at least partially greater than 180 degrees, the collar end CE is incapable from disengaging the opening 330 during use (e.g., lifting the barbell B when one or more kettle bells 300 are removably attached). According to one example embodiment, a clasp or fastener 350 can be provided for further securing the collar end CE to the kettle bell 300, or for example, for further securing the kettle bell 300 to the collar end CE.

In example embodiments, the kettle bell 10 is generally formed from a cast iron material, or can optionally be formed with other dense metals or other materials, sand, etc. Preferably, the total weight of the kettle bell 10 is generally between 5-115 lbs. According to some example embodiments, the kettle bell 10 can be configured to be weighted generally similar to known disc-shaped weights, for example, between about 5-45 lbs. Optionally, as described above, the kettle bell 10 can be weighted as desired, for example, which can be more than 45 lbs.

According to another example embodiment, the present invention relates to a method of using a kettle bell for exercising. The method includes providing a kettle bell, the kettle bell comprising a generally spherical shaped weighted mass, a generally flat bottom for resting atop a support surface, a handle extending from an upper portion of the mass to form a loop-like grasping ring, and an opening extending entirely through a generally central area of the mass; grasping the kettle bell with one or more hands of a user; performing one or more exercises; providing a barbell comprising male collar end receivers; removably attaching a kettle bell to each of the collar end receivers, wherein the collar end receivers are fitted through the opening of each kettle bell; and performing one or more exercises by grasping and lifting the barbell.

According to another example embodiment, an engagement clasp, ring, or other connector can be provided, for example, for removably attaching the kettle bell to the collar end of the barbell. For example, rather than engaging the collar end CE with an opening formed through the mass or through the opening defined between the grasping ring and the mass, a separate attachment ring or coupling member can accommodate attachment of the kettle bell with the collar end CE of the barbell B. According to one example embodiment, the coupling member is configured for both removably engaging the collar end of the barbell B and for coupling to a portion of the kettle bell. In example forms, the coupling member can provide for removable engagement with the grasping ring of the kettle bell. In some example embodiments, on or more fasteners, clips, latch mechanisms, couplings, etc. provide for removably securing the kettle bell to the collar ends of the barbell B.

According to another example embodiment, the present invention relates to a retrofitted kettle bell, which can be used for grasping by one or more hands of a user to perform one or more exercises, or for removably attachment to collar ends of a barbell for performing one or more exercises utilizing the barbell. Thus, in example embodiments, a user can utilize one or more retrofitted kettle bells for performing a plurality of different exercises (with or without a barbell B), for example, rather than only being able to utilize the kettle bell for user-performed exercises where the user grasps the handle with one or more hands.

Figure 9:
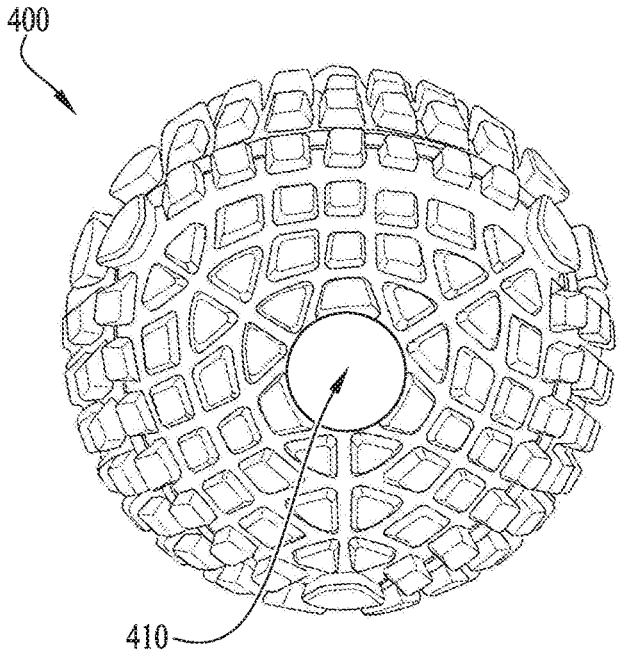
FIGS. 9-11 show a multi-use weighted exercise device according to another example of the present invention.
Figure 10:
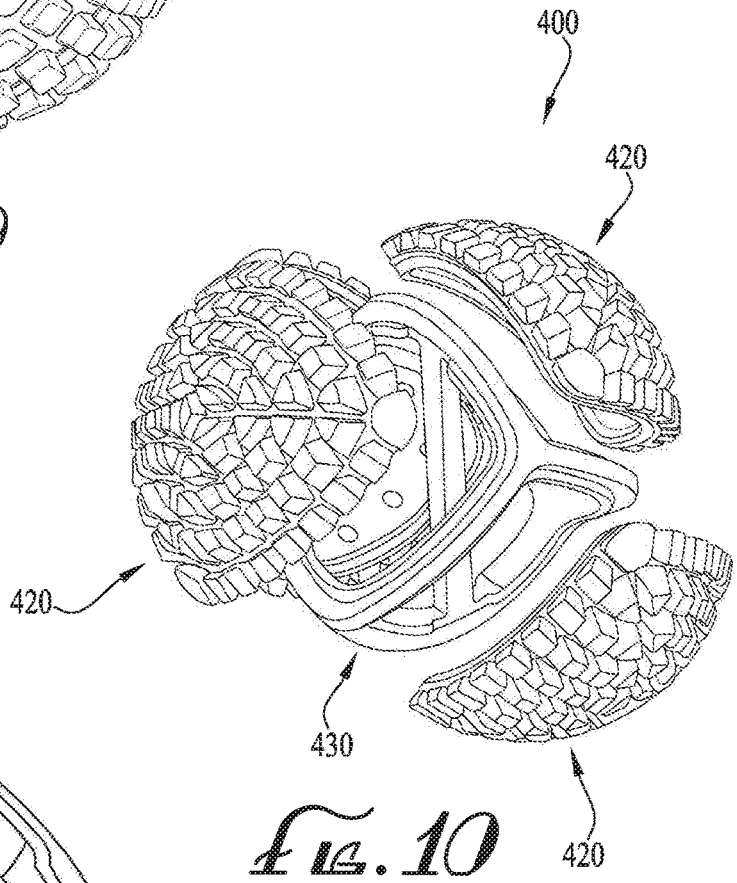
Figure 11:
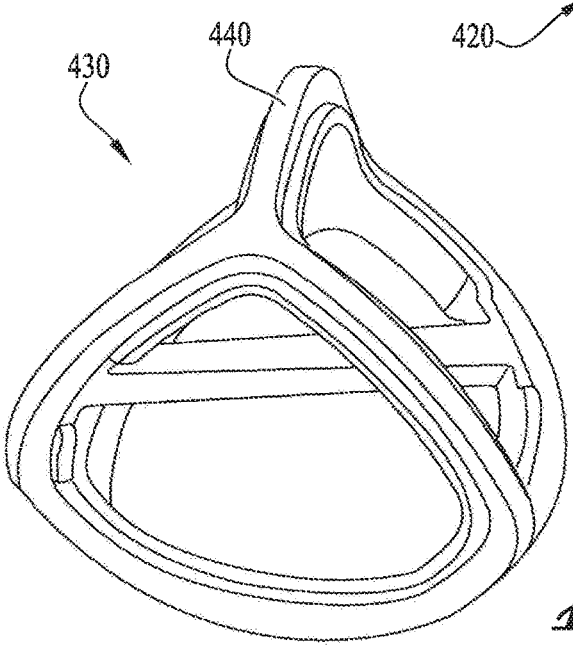

According to another example embodiment, the present invention comprises an exercise device, for example, an exercise ball device, or for example, a weighted, multi-use exercise ball 400 (see FIGS. 9-11). For example, according to example embodiments, the device 400 can be used for manual interaction with a user (e.g., like a medicine ball), or for example, the ball (or portions thereof) can be used for attachment to a collar end CE of a barbell. In example embodiments, the device 400 comprises a generally cylindrical opening 410 extending through the entirety of the device 410, for example, which is preferably sized and shaped for receiving the collar end CE of a barbell B. According to example embodiments, as depicted in FIG. 10, the device 400 generally comprises a plurality of panels or shells 420 for removable attachment to a frame component 430. U.S. Patent Application No. 2014/0336021 is incorporated by reference herein in its entirety and discloses an exercise device having a frame and multiple panels for attachment to the frame. According to one example embodiment, the opening 410 is formed by a plurality of cutouts formed in the shells 420, for example, such that assembly and attachment of the shells 420 to the frame 430 defines the opening 410. According to example embodiments, the frame 430 can further be utilized as a kettle bell, for example, wherein one or more weighted components or members can be attached to the frame, and wherein a portion of the frame 430 can be grasped by one or more hands of the user (see handle 440). According to example embodiments, the shells 420 can be weighted as desired, for example, being formed from a metal, non-metal or other dense material. According to another example embodiment, the frame 430 (and one or more weights attached to the frame 430) can be configured for attachment to the collar end CE of a barbell B.

Optionally, rather than removably engaging the kettle bells or exercise device with the collar ends CE of a barbell, a curl bar can be utilized, for example, which comprises similar sized collar ends for sliding engagement with the opening of the kettle bell or exercise device.

Figure 12:
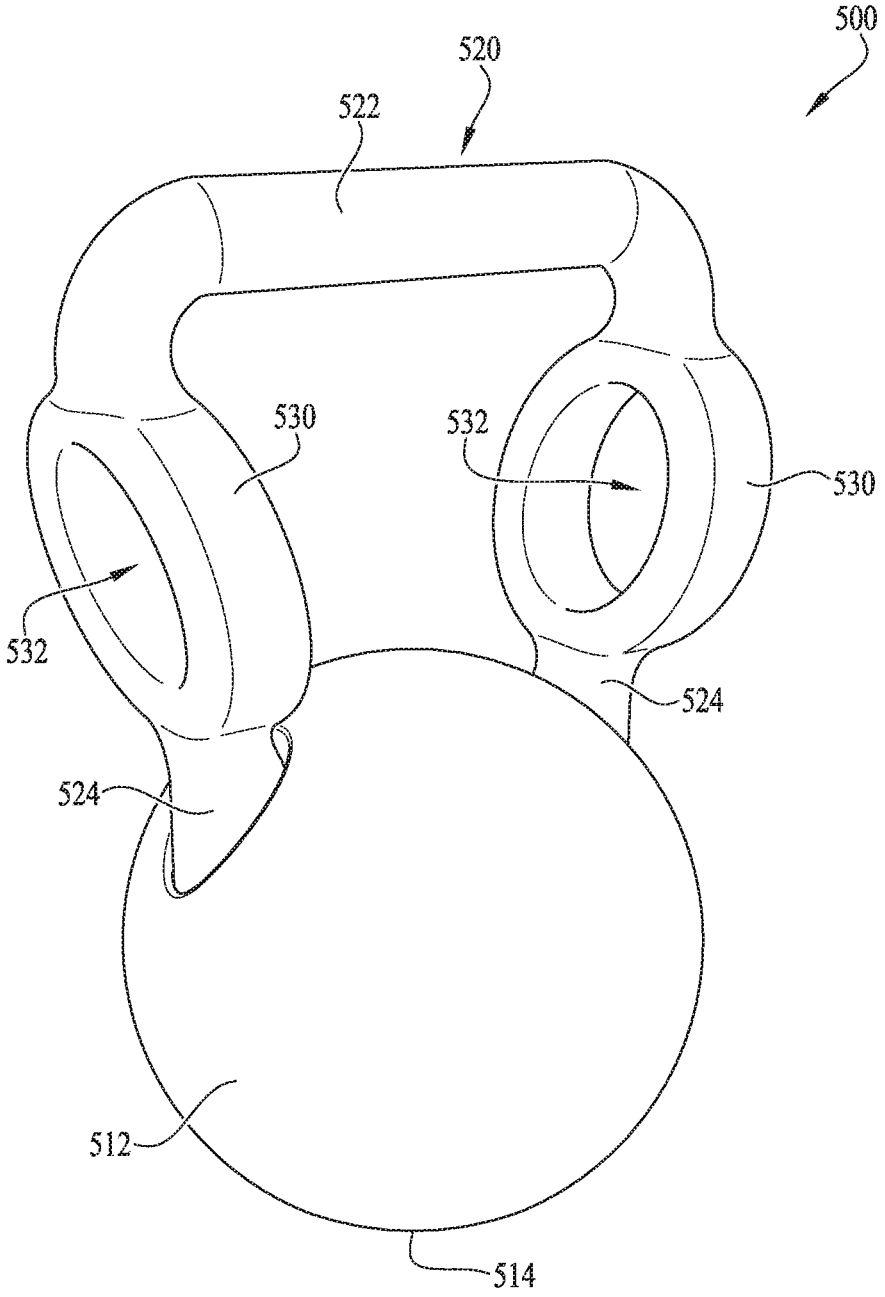
FIGS. 12-14 show a kettle bell according to another example embodiment of the present invention.
Figure 13:
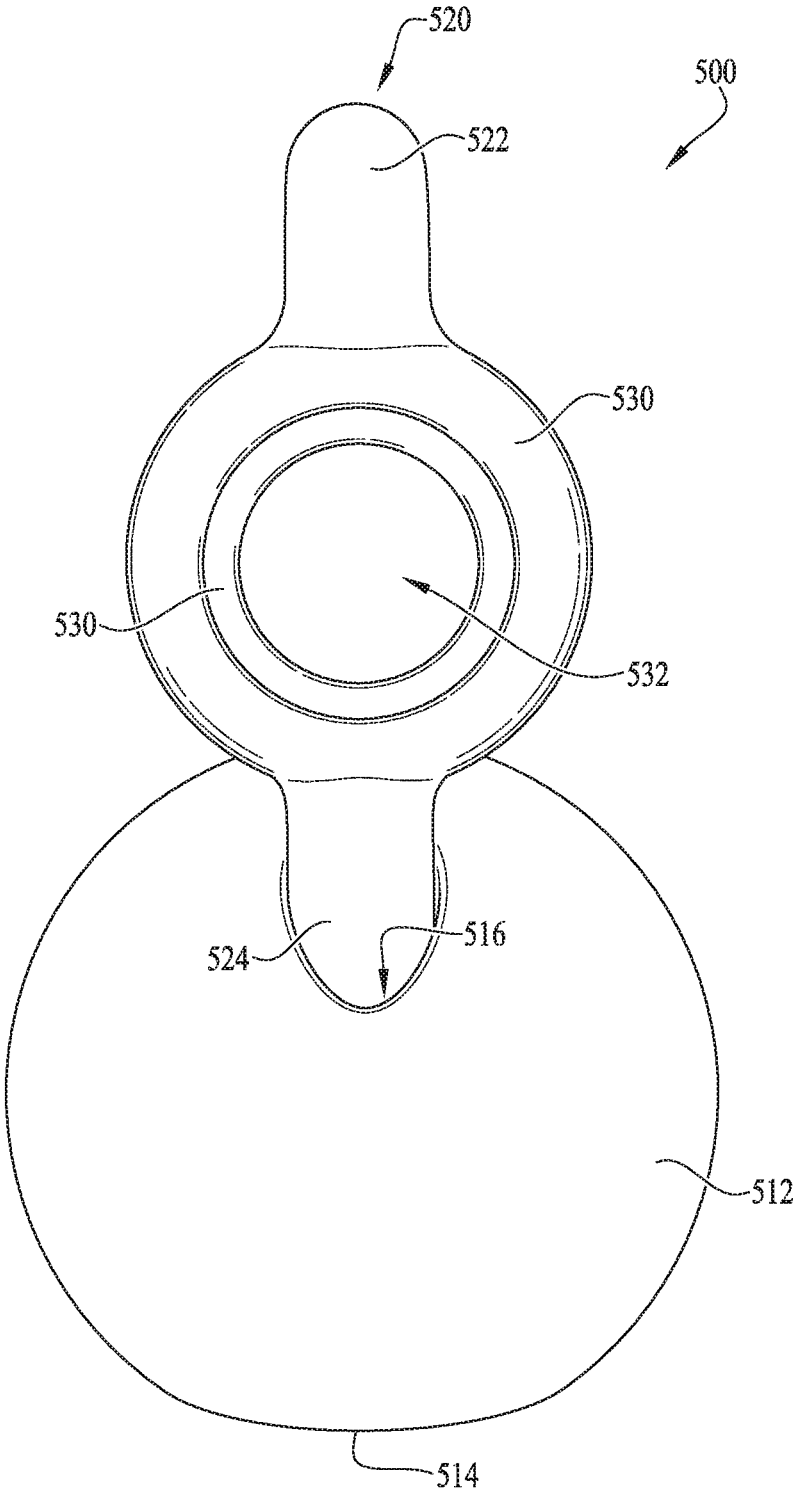
Figure 14:
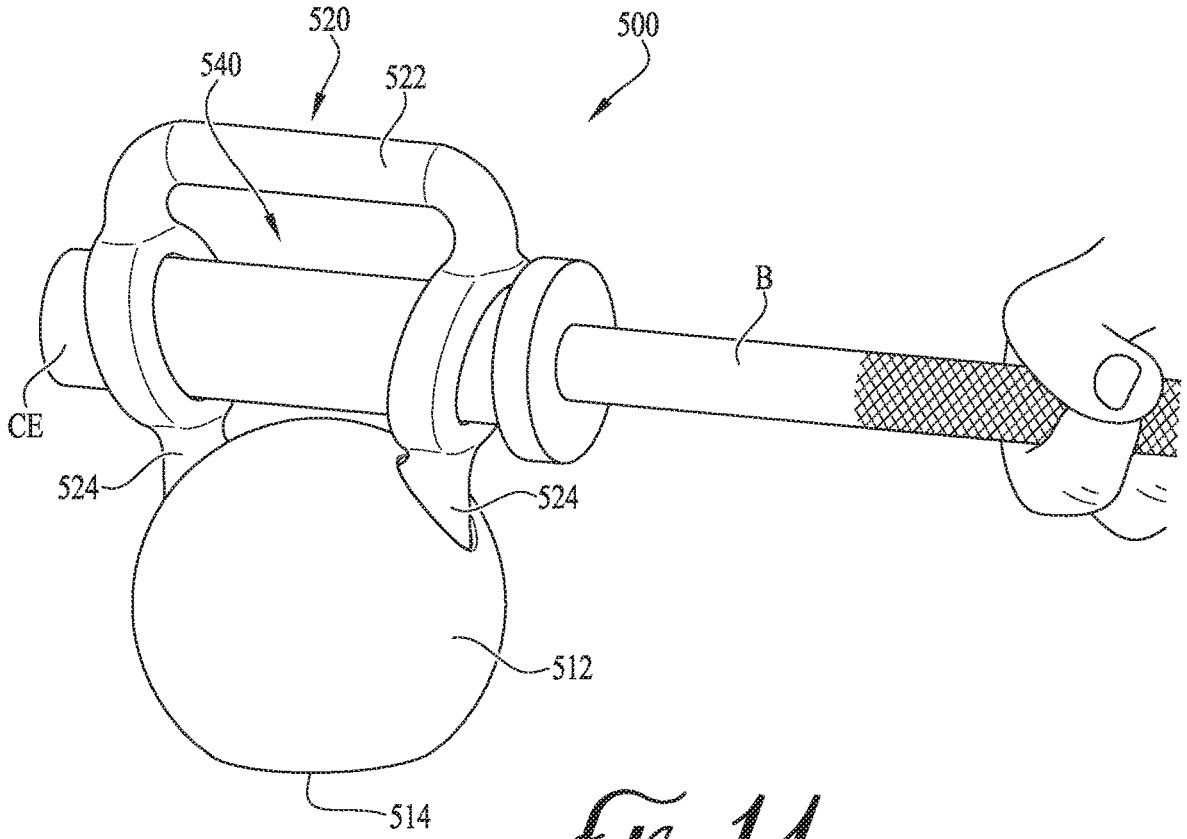

According to one example embodiment of the present invention, the grasping ring of the kettle bell can comprise two generally spaced-apart rings, which are generally integrally formed with the handle, and which are sized and shaped for receiving the collar ends CE of the barbell B. For example, as depicted in FIGS. 12-14, the kettle bell 500 comprises a base portion or mass 512 and a grasping ring 520, and a ring or collar member 530 is provided on each extension portion extending from the grasping handle 522. In example embodiments, the collar members 530 define receivers or openings 532 passing therethrough, for example, such that the collar end CE of a barbell B is removably engagable with the collar members 530 of the grasping ring 520, for example, wherein the openings 532 are generally sized to permit insertion of the collar end CE therethrough. In example embodiments, the grasping ring 520 can be grasped for manual exercise (e.g., the grasping handle 522) or can removably engage the collar end CE of a barbell B, or for example, other collar ends CE as described herein, for example, a curling bar, shorter barbell or other bar or device comprising one or more collar ends CE. Preferably, the base portion or mass 512 can be shaped as desired.

As depicted in FIG. 13, the mass 512 comprises a pair of receivers 516 for receiving extension ends 524 of the extensions of the grasping handle 522. In some example embodiments, the grasping ring 520 and mass 512 are separately formed and permanently connected together. In other example embodiments, the grasping ring 520 and mass 512 can be configured for removable coupling engagement, for example, such that one or more other grasping rings can be interchanged with the mass 512, for example, to provide additional functionality and/or connectability. According to another example embodiment, the grasping ring and the mass can be integrally formed together as one piece, for example, by a cast, molding, or other available manufacturing process.

As depicted in FIG. 14, the kettle bell 500 is removably mounted to a collar end CE of a curl bar. Preferably, according to example embodiments of the invention, an opening or pass-through 540 is defined between the grasping handle 522 and the collar end CE. Preferably, the pass-through 540 allows for grasping of the grasping handle 522 when the kettle bell 500 is removably mounted to the collar end CE, for example, such that the user can easily remove or place the kettle bell on the collar end CE as desired.

As described above and according to example embodiments, the kettle bell 500 is generally formed from a cast iron material, or can optionally be formed with other dense metals or other materials, sand, etc. According to other example embodiments, the kettle bell 500 can be formed from one or more materials as desired. According to some example embodiments, substantially dense pellets or other small spherical members or other media can be filled within a reservoir defined by at least a portion thereof. In some example embodiments, the dense pellets comprise a high packing factor, for example, to maximize the amount of pellets that can be contained within the reservoir. According to example embodiments, the total weight of the kettle bell 500 is generally between 5-115 lbs. According to some example embodiments, the kettle bell 500 can be configured to be weighted generally similar to known disc-shaped weights, for example, between about 5-45 lbs. Optionally, as described above, the kettle bell 500 can be weighted as desired, for example, which can be more than 45 lbs.

According to additional example embodiments, one or more kettle bells can be removably mounted and temporarily secured to the male receivers or collar ends of a barbell or other exercise equipment (free weight and/or exercise machine) as desired. For example, according to some example embodiments, one or more kettle bells comprising a receiver opening can be configured for removable attachment to a male portion (e.g., for receiving one or more weights) of an exercise machine. For example, where the exercise machine comprises a male portion or shaft that is generally used for receiving one or more disc weights, one or more kettle bells comprising the at least one receiver opening or other male attachment member or mechanism can be removably mounted to the male portion of the exercise machine. According to further example embodiments, one or more additional accessories or other members, mechanisms, clamps, clips, rings, clasps, or other features formed with the bell or separate and mountable to the kettle bell can provide for removable mounting thereof to a barbell or other free weight bar or exercise machine. In example embodiments, a separate piece is provided such that the kettle bell can be retrofitted for removable and secure attachment to a barbell or other free weight bar or exercise equipment.

While the invention has been described with reference to preferred and example embodiments, it will be understood by those skilled in the art that a variety of modifications, additions and deletions are within the scope of the invention, as defined by the following claims.

What is claimed is:

1. A kettle bell comprising a generally spherical weighted mass, a handle extending from an upper portion of the weighted mass to form a grasping ring, and at least one receiver opening configured for attachment of the kettle bell to a male collar of an exercise device, the at least one receiver opening being off-center of the center of mass and permitting rotation of the kettle bell with respect to the male collar, said off-center opening configured to maintain the kettle bell's orientation during exercise.

2. The kettle bell of claim 1, wherein the at least one receiver opening is at least partially formed in the weighted mass.

3. The kettle bell of claim 1, wherein the at least one receiver opening is at least partially formed in the grasping ring.

4. The kettle bell of claim 1, wherein the weighted mass comprises a generally flat bottom for resting atop a support surface.

5. The kettle bell of claim 1, wherein at least the spherical shaped weighted mass comprises iron.

6. The kettle bell of claim 1, wherein the kettle bell comprises a total weight of between 5-115 pounds.

7. A multi-use exercise device comprising:

a generally spherical weighted mass; and a grasping handle extending from the weighted mass and comprising a grasping portion and extension portions extending from the grasping portion, the extension portions each comprising a receiver configured for removable engagement with a collar end of a barbell, wherein the receivers of the extension portions are generally axially aligned with respect to each other so as to permit receiving the collar end of the barbell therethrough, and wherein the receivers permit rotation of the exercise device with respect to the barbell and maintain the exercise device's orientation during exercise.

8. The multi-use exercise device of claim 7, wherein the weighted mass comprises a pair of receivers and the extension portions of the grasping ring comprise extension ends for providing engagement with the receivers of the weighted mass.

9. The multi-use exercise device of claim 7, wherein at least the weighted mass comprises iron.

10. The multi-use exercise device of claim 7, wherein the multi-use exercise device comprises a total weight of between 5-115 pounds.

11. The multi-use exercise device of claim 7, wherein the weighted mass comprises a generally flat bottom for resting atop a support surface.

12. A method of using a kettle bell for exercising comprising:

providing a kettle bell comprising a center of mass, the kettle bell comprising a generally spherical weighted mass, a handle extending from an upper portion of the weighted mass to form a grasping ring, and at least one receiver opening that is offset from the center of mass of the kettle bell;

grasping the grasping ring of the kettle bell with one or more hands of a user;

performing one or more exercises;

providing a barbell comprising male collar end receivers;

removably attaching a kettle bell to each of the collar end receivers, wherein the collar end receivers are fitted through the at least one receiver opening of each kettle bell, the male collar end receivers permitting rotation of the kettle bells with respect to the male collar end receivers; and performing one or more exercises by grasping and lifting the barbell, wherein the male collar end receivers are configured to maintain the orientation of each kettle bell during exercise.

13. The method of claim 12, wherein the at least one receiver opening is at least partially formed in the weighted mass.

14. The method of claim 12, wherein the at least one receiver opening is at least partially formed in the handle.

15. The method of claim 12, wherein the weighted mass comprises a generally flat bottom for resting atop a support surface.

16. The method of claim 12, wherein at least the spherical shaped weighted mass comprises iron.

17. The method of claim 12, wherein the kettle bell comprises a total weight of between 5-115 pounds.

18. The method of claim 12, wherein the kettle bell further comprises a clasp or fastener for securing the kettle bell to the collar end of the barbell.

19. The kettle bell of claim 1, wherein the male collar of the exercise device comprises a collar end of a barbell.

20. The kettle bell of claim 1, wherein the male collar of the exercise device comprises a male collar end affixed to exercise equipment.

* * * * *